US011136953B2

(12) United States Patent
Chinnici et al.

(10) Patent No.: US 11,136,953 B2
(45) Date of Patent: Oct. 5, 2021

(54) FUEL INJECTOR WITH A LOCATING PIN, INTERNAL COMBUSTION ENGINE USING THE SAME, AND METHOD

(71) Applicant: DELPHI TECHNOLOGIES IP LIMITED, St. Michael (BB)

(72) Inventors: David A. Chinnici, Rochester, NY (US); Charles W. Braun, Canandaigua, NY (US); Gary J. De Angelis, Spencerport, NY (US)

(73) Assignee: DELPHI TECHNOLOGIES IP LIMITED

( * ) Notice: Subject to any disclaimer, the term of this patent is extended or adjusted under 35 U.S.C. 154(b) by 0 days.

(21) Appl. No.: 16/196,871

(22) Filed: Nov. 20, 2018

(65) Prior Publication Data

US 2020/0158064 A1 May 21, 2020

(51) Int. Cl.
*F02M 61/14* (2006.01)
*F02M 61/18* (2006.01)

(52) U.S. Cl.
CPC ..... *F02M 61/14* (2013.01); *F02M 61/18* (2013.01); *F02M 2200/852* (2013.01); *F02M 2200/858* (2013.01); *F02M 2200/9015* (2013.01)

(58) Field of Classification Search
CPC ..... F02M 2200/852; F02M 2200/9015; F02M 2230/604; F05B 2230/604; Y10T 29/49895–49902; B23Q 16/08; B23Q 3/18
See application file for complete search history.

(56) References Cited

U.S. PATENT DOCUMENTS 3,346,188 A * 10/1967 Nusbaum ..... F02M 57/02 239/90
3,918,694 A * 11/1975 Laudick ..... B23Q 16/08 269/47
5,263,881 A * 11/1993 Henrici ..... H01R 13/506 439/683
6,554,643 B1 * 4/2003 Whiting ..... H01R 12/7064 439/567
6,775,919 B2 * 8/2004 Liebig ..... B23Q 3/18 33/613

(Continued)

FOREIGN PATENT DOCUMENTS

EP 2587047 A1 5/2013
JP 2003336611 A 11/2003
WO WO-2018147330 A1 * 8/2018 ..... F04D 19/002

*Primary Examiner* — Hung Q Nguyen
*Assistant Examiner* — Mark L. Greene
(74) *Attorney, Agent, or Firm* — Joshua M. Haines

(57) ABSTRACT

A fuel injector includes a nozzle body to be inserted into a fuel injector receiving bore along a nozzle body axis; a valve housing; and a locating pin extending from the valve housing along a locating pin axis. The locating pin axis is eccentric to the nozzle body axis. The locating pin has a width in a first direction radially relative to the nozzle body axis and through the locating pin axis and a length in a second direction perpendicular to the width such that the width is less than the length. The locating pin includes a first crush rib and a second crush rib which are diametrically opposed at the length of the locating pin and such that the first crush rib and the second crush rib plastically deform when inserted into the locating bore, thereby preventing rotational movement of the fuel injector about the nozzle body axis.

20 Claims, 6 Drawing Sheets

(56) References Cited

U.S. PATENT DOCUMENTS

| | | | | |
|---|---|---|---|---|
| 6,840,227 | B2 | 1/2005 | Reiter et al. | |
| 7,886,717 | B2 | 2/2011 | Rettig et al. | |
| 8,047,183 | B2 | 11/2011 | Aronhalt et al. | |
| 10,415,525 | B2 | 9/2019 | Del Rossa | |
| 2004/0060544 | A1 | 4/2004 | Reiter et al. | |
| 2014/0304944 | A1* | 10/2014 | Carr | A47L 15/4257 16/110.1 |
| 2015/0075496 | A1 | 3/2015 | Pasquali et al. | |
| 2019/0316601 | A1* | 10/2019 | Shimamoto | F04D 19/002 |

* cited by examiner

FUEL INJECTOR WITH A LOCATING PIN, INTERNAL COMBUSTION ENGINE USING THE SAME, AND METHOD

TECHNICAL FIELD OF INVENTION

The present invention relates to a fuel injector for injecting fuel into a combustion chamber of an internal combustion engine, and more particularly to such a fuel injector with a locating pin which orients the fuel injector relative to the combustion chamber and prevents rotation of the fuel injector.

BACKGROUND OF INVENTION

Fuel systems in modern internal combustion engines commonly inject fuel directly into a combustion chamber of the internal combustion engine. The fuel injector incudes a nozzle body which is inserted into a fuel injector receiving bore of the internal combustion engine along a nozzle body axis. In order to achieve optimal combustion of the fuel provided by the fuel injector, thereby maximizing fuel efficiency and minimizing harmful exhaust emissions, it is known to orient the fuel injector relative to the combustion chamber in such a way that is most conducive of achieving optimal combustion. One known way to orient the fuel injector is illustrated in U.S. Pat. No. 7,886,717 to Rettig et al. where the fuel injector is provided with a fixation device which is received within a recess of the internal combustion engine which limits the extent to which the nozzle body is able to rotate within the fuel injector receiving bore. The fixation device of Rettig et al. is a feature which is formed in a plastic injection molding process with a valve housing of the fuel injector. In arrangements such as Rettig et al., the fixation device is designed to provide a clearance fit with the recess in order to accommodate for manufacturing variations when forming the fixation device. This clearance fit allows for some rotation of the fuel injector about the nozzle body axis, thereby resulting in variations in how the spray from the fuel injector is introduced into the combustion chamber. As a result, the spray from the fuel injector may not be optimally placed in the combustion chamber which may lead to reduced fuel economy and increased harmful exhaust emissions.

What is needed is a fuel injector which minimizes or eliminates one or more of the shortcomings as set forth above.

SUMMARY OF THE INVENTION

Briefly described, a fuel injector is provided by the present invention for injecting fuel into a combustion chamber of an internal combustion engine. The fuel injector includes a nozzle body configured to be inserted into a fuel injector receiving bore of the internal combustion engine along a nozzle body axis; a valve housing held in fixed relationship to the nozzle body; and a locating pin extending from the valve housing along a locating pin axis from a locating pin fixed end which is fixed to the valve housing to a locating pin free end such that the locating pin is configured to radially orient the nozzle body in the fuel injector receiving bore, the locating pin being configured to be inserted into a locating bore. The locating pin axis is eccentric to the nozzle body axis and has 1) a width in a first direction radially relative to the nozzle body axis and through the locating pin axis and 2) a length in a second direction which is perpendicular to the width such that the width is less than the length. The locating pin includes a first crush rib projecting outward therefrom and also includes a second crush rib projecting outward therefrom such that the first crush rib and the second crush rib are diametrically opposed at the length of the locating pin and such that the first crush rib and the second crush rib are configured to plastically deform when inserted into the locating bore, thereby preventing rotational movement of the fuel injector about the nozzle body axis. An internal combustion engine including the fuel injector is also provided by the present invention. A method of assembling the fuel injector to the internal combustion engine is also provided by the present invention. The method includes inserting the nozzle body into the fuel injector receiving bore; inserting the locating pin into the locating bore; and plastically deforming the first crush rib and the second crush rib while the locating pin is being inserted into the locating bore such that the locating pin radially orients the nozzle body in the fuel injector receiving bore and thereby prevents rotational movement of the fuel injector about the nozzle body axis.

The fuel injector, internal combustion engine, and method of assembling the fuel injector to the internal combustion engine included herein provide for positive orientation, by forcing the locating pin to the center of the locating bore, of the fuel injector relative to the combustion chamber of the internal combustion engine which is necessary to achieve desired combustion of the fuel, thereby maximizing fuel efficiency, minimizing harmful exhaust emissions, and minimizing variation in fuel injector to combustion chamber placement.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
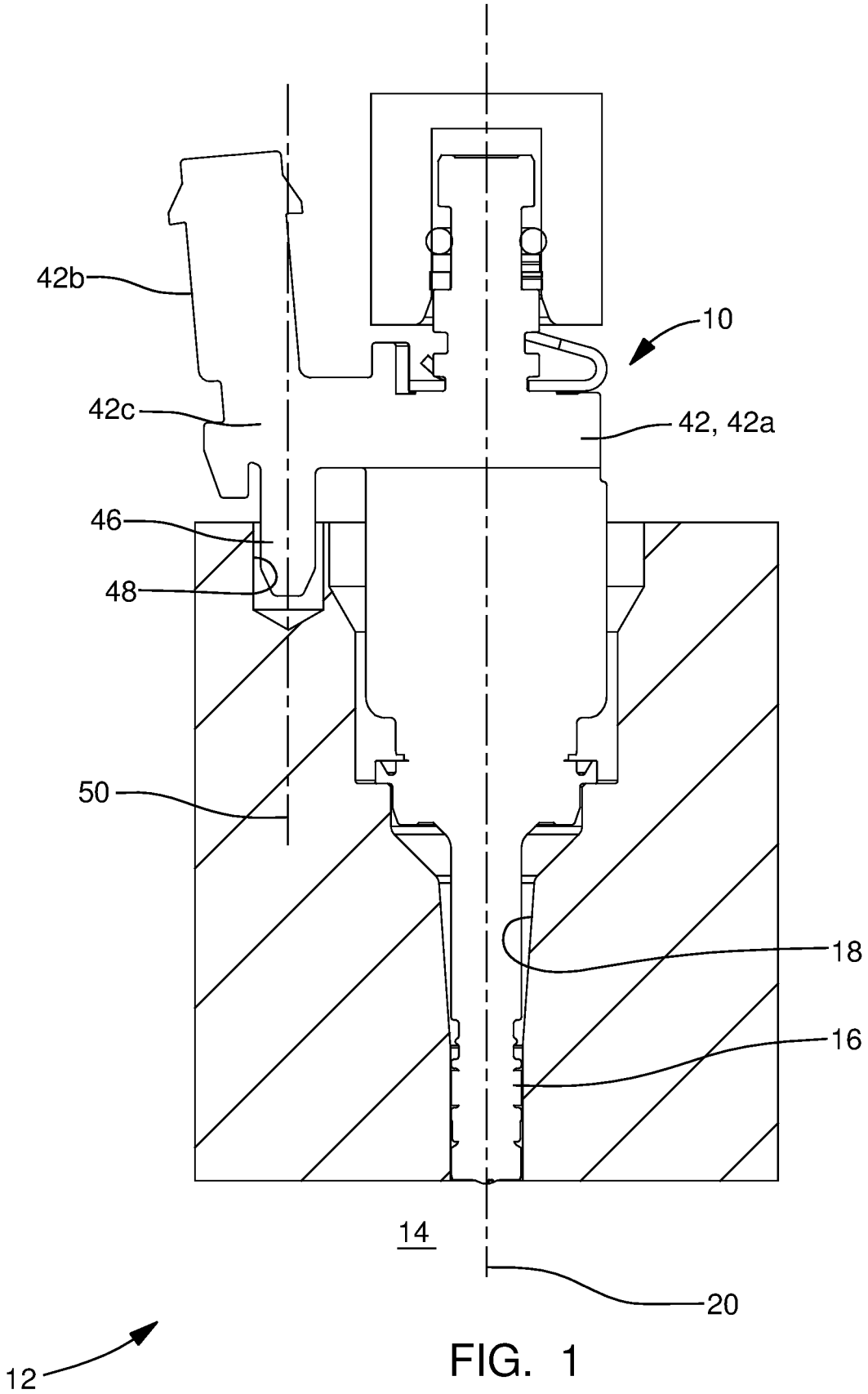
FIG. 1 is an elevation view of a fuel injector in accordance with the present invention installed in an internal combustion engine.
Figure 2:
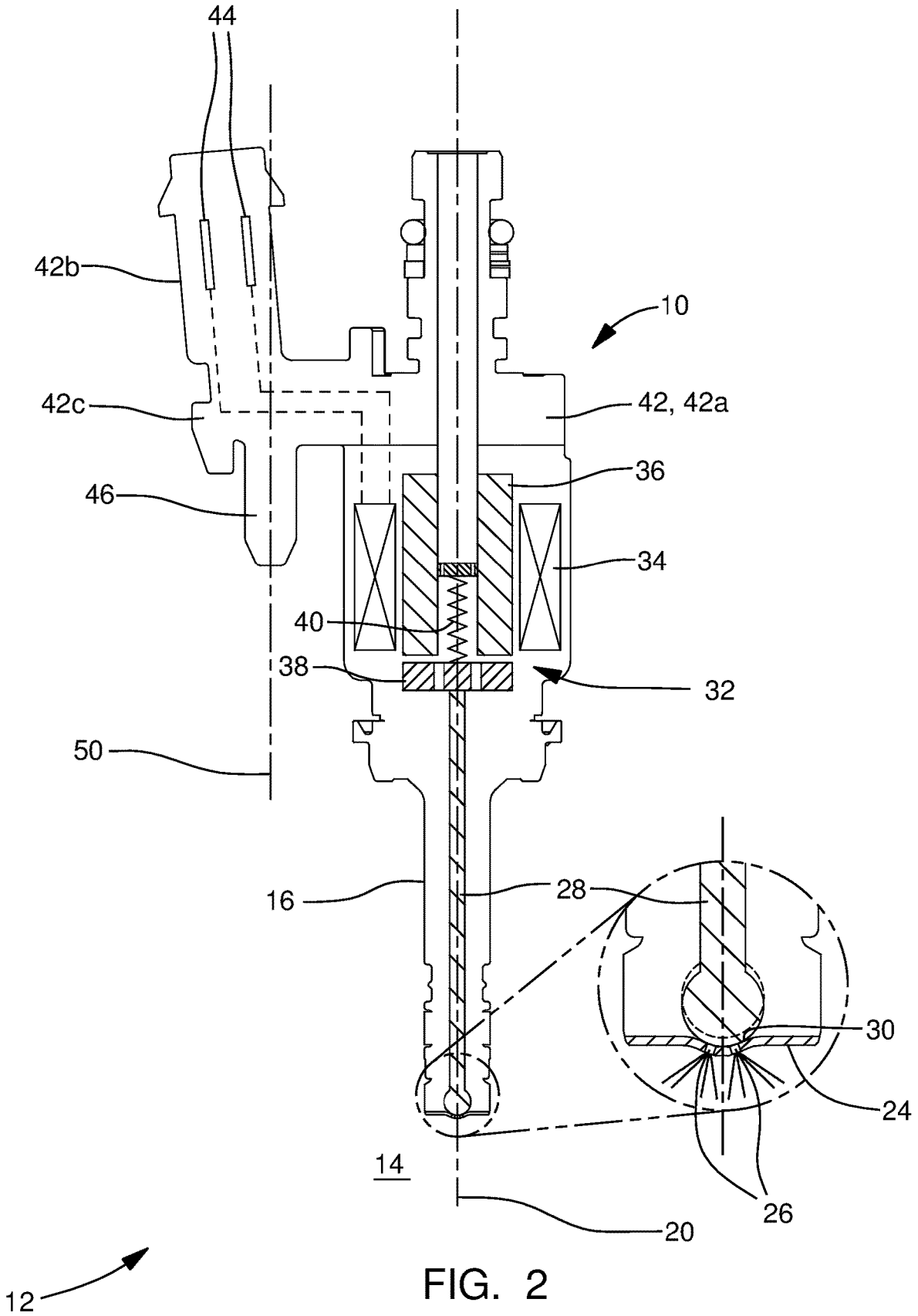
FIG. 2 is a schematic view of the fuel injector of FIG. 1.

In accordance with a preferred embodiment of this invention and referring initially to FIGS. 1 and 2, a fuel injector 10 is illustrated installed in an internal combustion engine 12 where fuel injector 10 is provided for injecting fuel into a combustion chamber 14 of internal combustion engine 12 where the fuel is combusted therein as is well known to those of ordinary skill in the art. The fuel which is injected by fuel injector 10 into combustion chamber 14 may be any one of numerous fuels commonly used by internal combustion engines, but may preferably be a liquid fuel which may be, by way of non-limiting example only, gasoline, alcohol, ethanol, diesel fuel, biodiesel, and the like or blends of one or more thereof or may alternatively be a gaseous fuel such as compressed natural gas (CNG) or propane.

Fuel injector 10 generally includes a nozzle body 16 which is configured to be inserted into a fuel injector receiving bore 18 of internal combustion engine 12 along a nozzle body axis 20 such that a nozzle tip 24 communicates with combustion chamber 14 and includes one or more nozzle openings 26 therein from which fuel is selectively discharged from fuel injector 10 into combustion chamber 14. The discharge of fuel from nozzle openings 26 is controlled by a valve needle 28 located within nozzle body 16 where valve needle 28 is selectively seated with a valve seat 30 (shown in solid lines in the enlarged portion of FIG. 2) to stop discharge of fuel through nozzle openings 26 and is selectively unseated with valve seat 30 (shown in phantom lines in the enlarged portion of FIG. 2) to discharge fuel from fuel injector 10 into combustion chamber 14. Movement of valve needle 28 is controlled by an actuator 32, illustrated herein as a solenoid actuator. As embodied herein, actuator 32 includes a wire winding 34, a pole piece 36 which is stationary, an armature 38 which is moveable with valve needle 28, and a return spring 40 which urges valve needle 28 in a direction to be seated with valve seat 30. When wire winding 34 is energized with an electric current, armature 38 is magnetically attracted to pole piece 36, thereby unseating valve needle 28 from valve seat 30. Conversely, when the electric current to wire winding 34 is stopped, the magnetic attraction between armature 38 and pole piece 36 is stopped, thereby allowing return spring 40 to move valve needle 28 to be seated with valve seat 30. While actuator 32 has been illustrated herein as a solenoid actuator, it should be understood that actuator 32 may take other forms, which may be, by way of non-limiting example only, a piezoelectric actuator. Furthermore, while actuator 32 has been illustrated as directly actuating valve needle 28, it should be understood that actuator 32 may be indirect acting such that the actuator may be used to control fuel pressure in a control chamber such that the fuel pressure in the control chamber affects the position of valve needle 28.

Fuel injector 10 also includes a valve housing 42 which is distal from nozzle tip 24. Valve housing 42 is held in fixed relationship to nozzle body 16 such that relative movement between valve housing 42 and nozzle body 16 is prevented. Valve housing 42 is made of a thermoplastic material which is preferably formed in a plastic injection molding process where liquefied plastic is injected into a mold (not shown) where the liquefied plastic is allowed to solidify before being removed from the mold. Valve housing 42 includes a valve housing first portion 42*a* which is used to fix valve housing 42 relative to nozzle body 16, a valve housing electrical connector 42*b* which includes electrical terminals 44 therein for providing electrical connection to actuator 32, and a valve housing intermediate portion 42*c* which joins valve housing first portion 42*a* to valve housing electrical connector 42*b*. Valve housing electrical connector 42*b* is configured to mate with a complementary electrical connector (not shown) which makes electrical connection with electrical terminals 44 to selectively supply electric current thereto.

In order to achieve desired combustion which produces low levels of emissions, nozzle tip 24 must be properly oriented with respect to combustion chamber 14 about nozzle body axis 20, thereby allowing fuel emitted from nozzle openings 26 to be introduced into combustion chamber 14 in such a way as to promote efficient combustion. It is important to note that the desired orientation of nozzle tip 24 with respect to combustion chamber 14 is dependent on may factors which may be, by way of non-limiting example only, the location of fuel injector receiving bore 18 relative to combustion chamber 14 and the location of a spark plug (not shown) which may be used to ignite the fuel. Furthermore, a practitioner of ordinary skill in the art would be able to determine the desired orientation of nozzle tip 24 with respect to combustion chamber 14, for example, through modeling or empirical testing. Fuel injector 10 includes a locating pin 46 extending from valve housing 42 which is configured to be inserted into a locating bore 48 in order to ensure proper orientation of nozzle tip 24 with respect to combustion chamber 14 about nozzle body axis 20 such that locating pin 46 prevents rotational movement of fuel injector 10 about nozzle body axis 20. Locating bore 48 may be located in the same portion of internal combustion engine 12 within which fuel injector receiving bore 18 is located or may be located in another element which is otherwise maintained in a fixed position relative to combustion chamber 14. Locating pin 46 will be described in greater detail in the paragraphs that follow.

Figure 3:
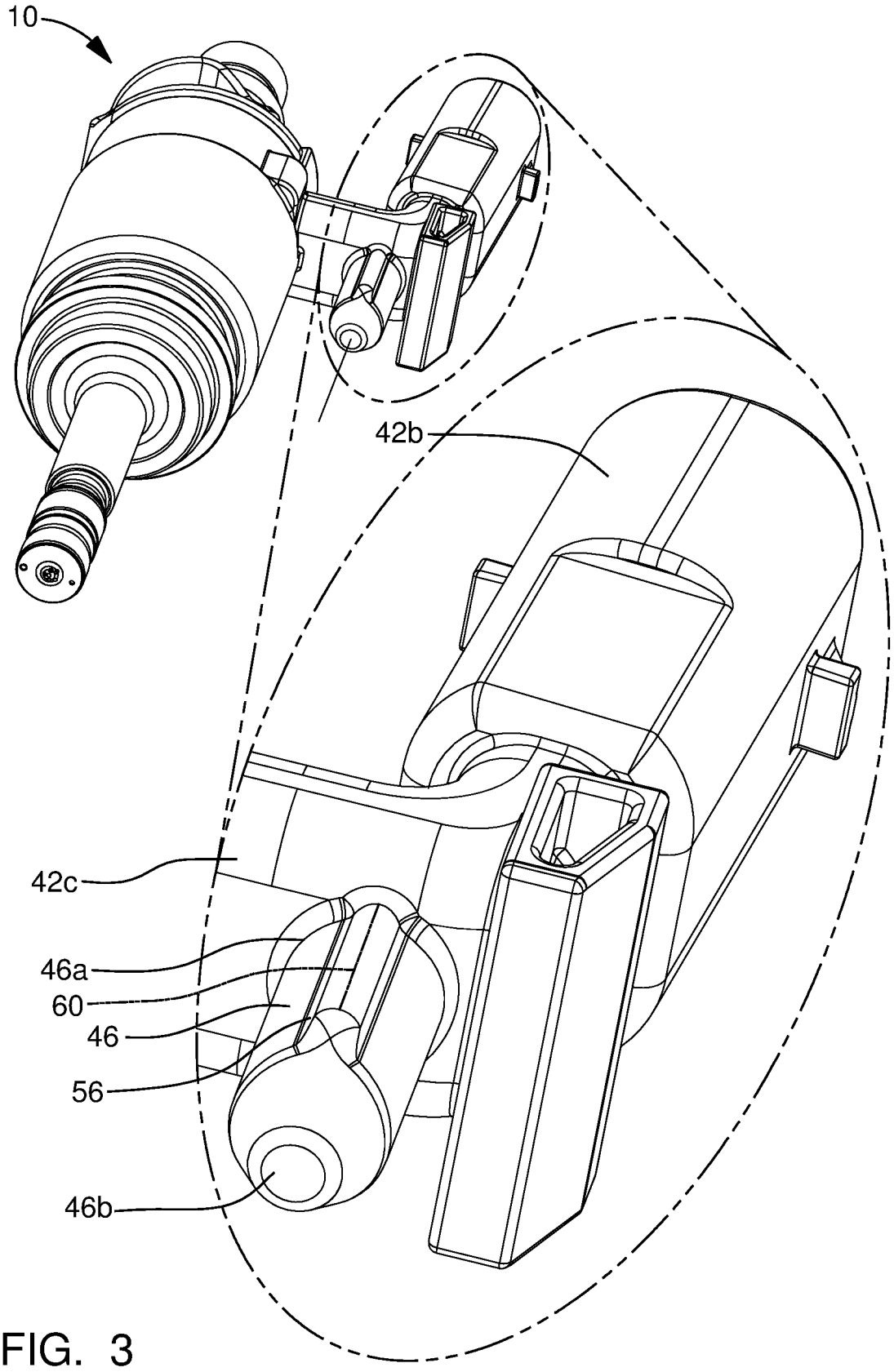
FIG. 3 is an isometric view of the fuel injector of FIG. 1.
Figure 4:
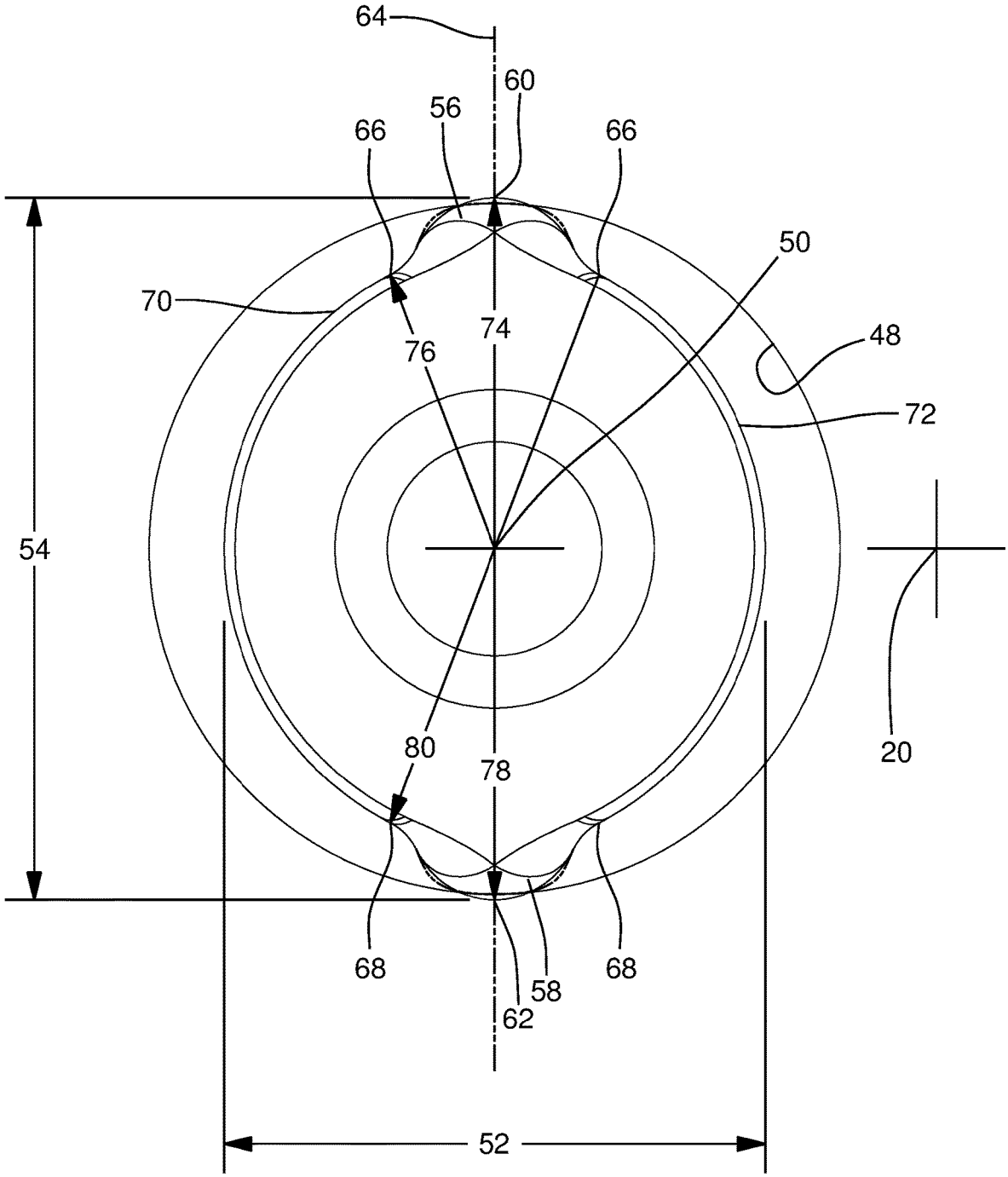
FIG. 4 is an end view of a locating pin of the fuel injector of FIG. 1.
Figure 5:
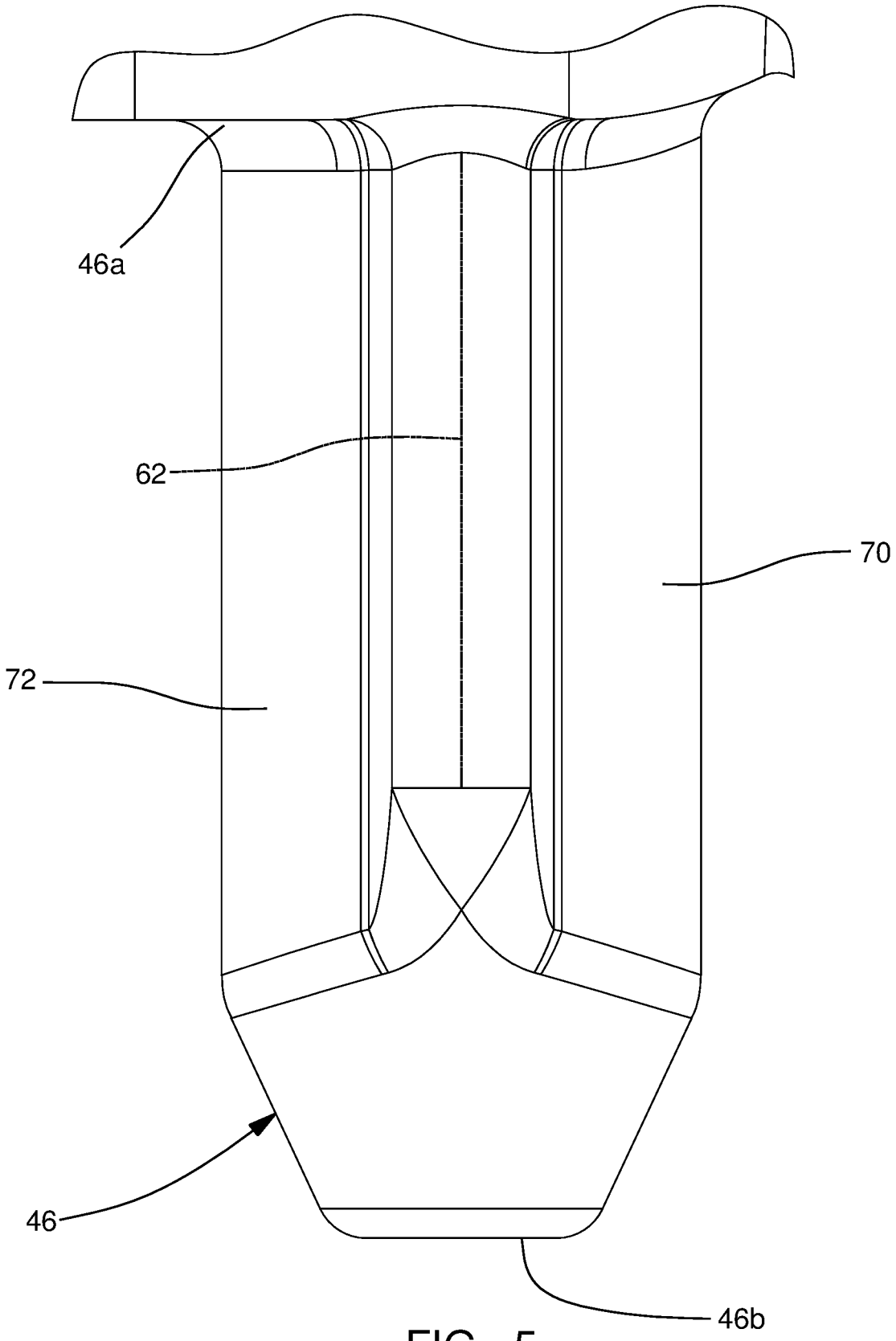
FIG. 5 is an elevation view of the locating pin.
Figure 6:
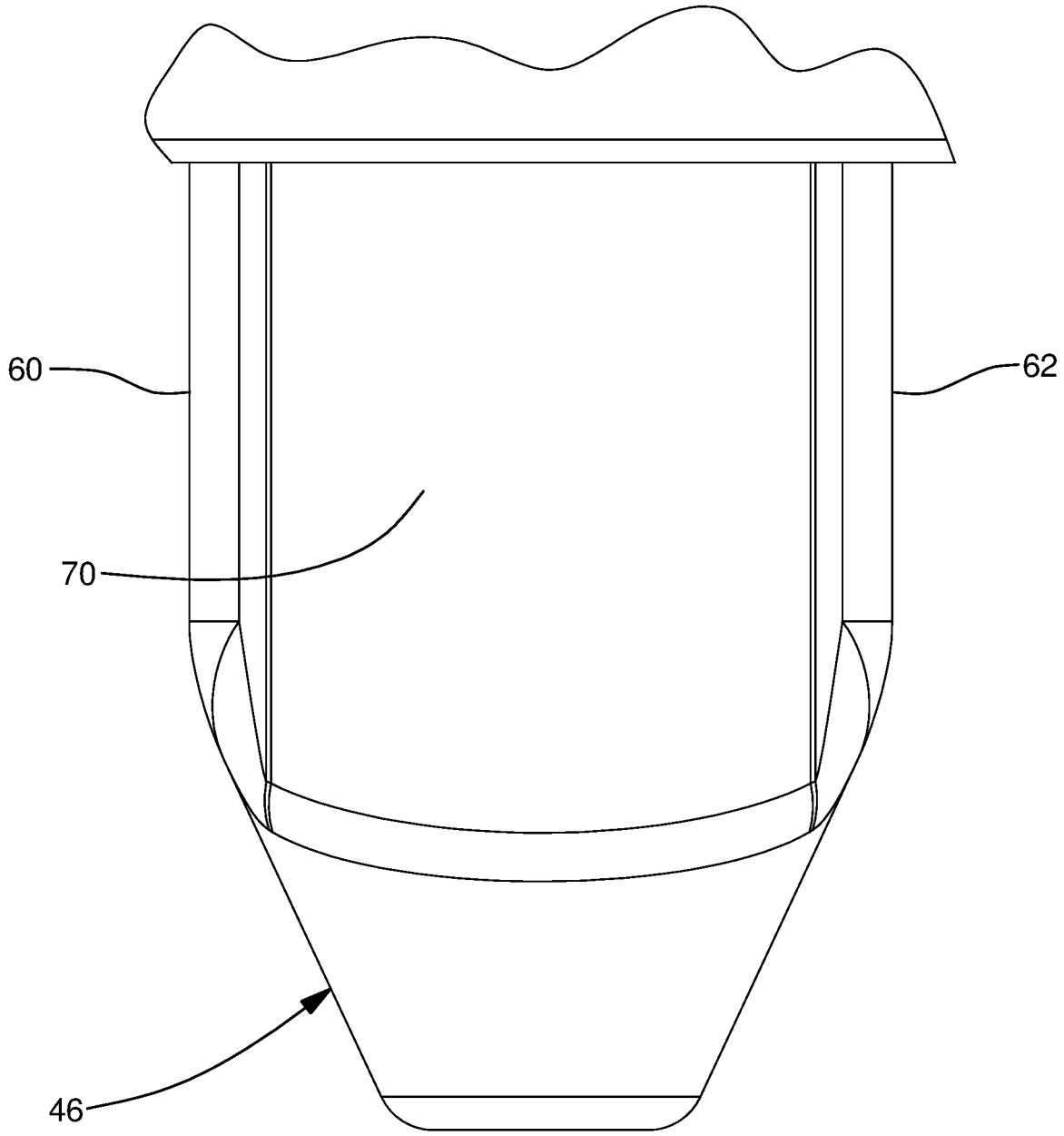
FIG. 6 is another elevation view of the locating pin, rotated 90° about a locating pin axis compared to FIG. 5.

Now with additional reference to FIGS. 3-6, locating pin 46 extends from valve housing 42, and more particularly valve housing intermediate portion 42*c*, along a locating pin axis 50. Locating pin 46 extends from a locating pin fixed end 46*a* which is fixed to valve housing 42 to a locating pin free end 46*b* which terminates locating pin 46. Locating pin axis 50 is eccentric to nozzle body axis 20 and is also preferably parallel to nozzle body axis 20 such that locating pin 46 is centered about locating pin axis 50. As shown in FIG. 4, locating pin 46 has a width 52 in a first direction radially relative to nozzle body axis 20 and through locating pin axis 50. Locating pin 46 also has a length 54 in a second direction which is perpendicular to width 52 and in a plane perpendicular to locating pin axis 50 such that length 54 is greater in magnitude than width 52. As should be apparent from FIG. 4, by having length 54 greater in magnitude than width 52, orientation of nozzle tip 24 is determined by locating pin 46 at length 54 and rotation about nozzle body axis 20 is prevented by locating pin 46 at length 54.

Locating pin 46 includes a first crush rib 56 projecting outward therefrom and extending along a direction from locating pin fixed end 46*a* toward locating pin free end 46*b*. Locating pin 46 also includes a second crush rib 58 projecting outward therefrom and extending along a direction from locating pin fixed end 46*a* toward locating pin free end 46*b* such that first crush rib 56 and second crush rib 58 are diametrically opposed to each other at length 54. As used herein, "diametrically opposed" includes being exactly diametrically opposed, i.e. spaced 180° apart about locating pin axis 50, and also includes deviations from being exactly diametrically opposed of up to 10° about locating pin axis 50. First crush rib 56 and second crush rib 58 are configured to plastically deform when locating pin 46 is inserted into locating bore 48, thereby radially orienting nozzle body 16 in fuel injector receiving bore 18 and also thereby preventing rotational movement of fuel injector 10 about nozzle body axis 20. It should be noted that FIG. 4 illustrates first crush rib 56 and second crush rib 58 in solid lines to represent a state prior to insertion in locating bore 48 and also illustrates first crush rib 56 and second crush rib 58 in phantom lines to represent a state after insertion in locating bore 48 where first crush rib 56 and second crush rib 58 are plastically deformed.

First crush rib 56 terminates radially outward from locating pin axis 50 in a first crush rib apex 60 which is linear as represented by a phantom line in FIG. 3. Similarly, second crush rib 58 terminates radially outward from locating pin axis 50 in a second crush rib apex 62 which is linear as represented by a phantom line in FIG. 5. First crush rib apex 60 and second crush rib apex 62 lie in a common plane 64 such that locating pin axis 50 is preferably coincident with common plane 64, i.e. every point of locating pin axis 50 lies on common plane 64 assuming locating pin axis 50 and common plane 64 extend infinitely. First crush rib apex 60 is preferably inclined relative to locating pin axis 50 such that first crush rib apex 60 is closer to locating pin axis 50 proximal to locating pin free 46*b* end than proximal to locating pin fixed end 46*a*. For example, first crush rib apex 60 may be inclined up to 10° relative to locating pin axis 50. Similarly, second crush rib apex 62 is preferably inclined relative to locating pin axis 50 such that second crush rib apex 62 is closer to locating pin axis 50 proximal to locating pin free 46*b* end than proximal to locating pin fixed end 46*a*. For example, second crush rib apex 62 may be inclined up to 10° relative to locating pin axis 50. In this way, a greater interference fit of locating pin 46 with locating bore 48 is achieved the further locating pin 46 is inserted into locating bore 48.

First crush rib 56 is arc-shaped when viewed in a direction parallel to locating pin axis 50, i.e. as viewed in FIG. 4, thereby forming a first crush rib inflection 66 on each side of first crush rib 56 such that first crush rib inflections 66 define the extent to which first crush rib 56 extends around the periphery of locating pin 46, i.e. extends around the outer periphery about locating pin axis 50. First crush rib 56 extends around the outer periphery of locating pin 46 for no more than 45° about locating pin axis 50. Similarly, second crush rib 58 is arc-shaped when viewed in a direction parallel to locating pin axis 50, thereby forming a second crush rib inflection 68 on each side of second crush rib 58 such that second crush rib inflections 68 define the extent to which second crush rib 58 extends around the periphery of locating pin 46, i.e. extends around the outer periphery about locating pin axis 50. Second crush rib 58 extends around the outer periphery of locating pin 46 for no more than 45° about locating pin axis 50. First crush rib 56 and second crush rib 58 bifurcate the outer periphery of locating pin 46 into a first locating pin surface 70 and a second locating pin surface 72. A first distance 74 radially outward from a point on locating pin axis 50 to first crush rib apex 60 is no more than 25% greater than a second distance 76 radially outward from the point on locating pin axis 50 to either of first crush rib inflections 66, i.e. the intersection of first locating pin surface 70 and first crush rib 56. Similarly, a third distance 78 radially outward from the point on locating pin axis 50 to second crush rib apex 62 is no more than 25% greater than a fourth distance 80 radially outward from the point on locating pin axis 50 to either of second crush rib inflections 68, i.e. the intersection of second locating pin surface 72 and second crush rib 58. Since each of first crush rib 56 and second crush rib 58 project outward no more than 25% than first locating pin surface 70 and second locating pin surface 72 and each of first crush rib 56 and second crush rib 58 extend around the outer periphery of locating pin 46 for no more than 45° about locating pin axis 50, first crush rib 56 and second crush rib 58 do not strengthen or reinforce locating pin 46 and also allow first crush rib 56 and second crush rib 58 to plastically deform when locating pin 46 is inserted into locating bore 48.

In order to assemble fuel injector 10 to internal combustion engine 12, nozzle body 16 is first aligned with, and inserted at least part way into, fuel injector receiving bore 18. Next, locating pin 46 is aligned with locating bore 48 and locating pin 46 is inserted into locating bore 48 such that inserting locating pin 46 includes plastic deformation of first crush rib 56 and second crush rib 58, thereby preventing rotation of fuel injector 10 about nozzle body axis 20. The step of inserting locating pin 46 into locating bore 48 may also include inserting nozzle body 16 further into locating bore 48.

While this invention has been described in terms of preferred embodiments thereof, it is not intended to be so limited, but rather only to the extent set forth in the claims that follow.

We claim:

1. A fuel injector for injecting fuel into a combustion chamber of an internal combustion engine, said fuel injector comprising:

a nozzle body configured to be inserted into a fuel injector receiving bore of said internal combustion engine along a nozzle body axis;

a valve housing held in fixed relationship to said nozzle body; and a locating pin extending from said valve housing along a locating pin axis from a locating pin fixed end which is fixed to said valve housing to a locating pin free end such that said locating pin is configured to radially orient said nozzle body in said fuel injector receiving bore, said locating pin being configured to be inserted into a locating bore;

wherein said locating pin axis is eccentric to said nozzle body axis;

wherein said locating pin has 1) a width in a first direction radially relative to said nozzle body axis and through said locating pin axis and 2) a length in a second direction which is perpendicular to said width such that said width is less than said length; and wherein said locating pin includes a first crush rib projecting outward therefrom and also includes a second crush rib projecting outward therefrom such that said first crush rib and said second crush rib are diametrically opposed at said length of said locating pin and such that said first crush rib and said second crush rib are configured to plastically deform when inserted into said locating bore, thereby preventing rotational movement of said fuel injector about said nozzle body axis.

2. The fuel injector as in claim 1, wherein:

said first crush rib terminates radially outward from said locating pin axis in a first crush rib apex which is linear;

said second crush rib terminates radially outward from said locating pin axis in a second crush rib apex which is linear; and said first crush rib apex and said second crush rib apex lie in a common plane.

3. The fuel injector as in claim 2, wherein said locating pin axis is coincident with said common plane.

4. The fuel injector as in claim 2, wherein:

said first crush rib is arc-shaped when viewed in a third direction parallel to said locating pin axis; and said second crush rib is arc-shaped when viewed in said third direction parallel to said locating pin axis.

5. The fuel injector as in claim 2, wherein:

said first crush rib apex is inclined relative to said locating pin axis such that said first crush rib apex is closer to said locating pin axis at a first location proximal to said locating pin free end than at a second location proximal to said locating pin fixed end; and said second crush rib apex is inclined relative to said locating pin axis such that said second crush rib apex is closer to said locating pin axis at a third location proximal to said locating pin free end than at a fourth location proximal to said locating pin fixed end.

6. The fuel injector as in claim 2, wherein said first crush rib and said second crush rib bifurcate an outer periphery of said locating pin into a first locating pin surface and a second locating pin surface.

7. The fuel injector as in claim 6, wherein:

a first distance radially outward from a point on said locating pin axis to said first crush rib apex is no more than 25% greater than a second distance radially outward from said point on said locating pin axis to an intersection of said first locating pin surface and said first crush rib; and a third distance radially outward from said locating pin axis to said second crush rib apex is no more than 25% greater than a distance radially outward from said locating pin axis to an intersection of said second locating pin surface and said second crush rib.

8. The fuel injector as in claim 2, wherein:

a first crush rib inflection is formed on each side of said first crush rib which define an extent to which said first crush rib extends around a periphery of said locating pin; and a second crush rib inflection is formed on each side of said second crush rib which define an extent to which said second crush rib extends around said periphery of said locating pin.

9. The fuel injector as in claim 8, wherein:

said first crush rib extends no more than 45° about said locating pin axis; and said second crush rib extends no more than 45° about said locating pin axis.

10. The fuel injector as in claim 1, wherein said first direction is in a plane which is perpendicular to said nozzle body axis and wherein said second direction is also in said plane.

11. An internal combustion engine comprising:

a combustion chamber;

a fuel injector receiving bore;

a locating bore; and a fuel injector comprising:

a nozzle body within said fuel injector receiving bore along a nozzle body axis;

a valve housing held in fixed relationship to said nozzle body; and a locating pin extending from said valve housing along a locating pin axis from a locating pin fixed end which is fixed to said valve housing to a locating pin free end such that said locating pin radially orients said nozzle body in said fuel injector receiving bore, said locating pin being located in said locating bore;

wherein said locating pin axis is eccentric to said nozzle body axis;

wherein said locating pin has 1) a width in a first direction radially relative to said nozzle body axis and through said locating pin axis and 2) a length in a second direction which is perpendicular to said width such that said width is less than said length; and said locating pin includes a first crush rib projecting outward therefrom and also includes a second crush rib projecting outward therefrom such that said first crush rib and said second crush rib are diametrically opposed at said length of said locating pin and such that said first crush rib and said second crush rib are plastically deformed within said locating bore, thereby preventing rotational movement of said fuel injector about said nozzle body axis.

12. The internal combustion engine as in claim 11, wherein:

said first crush rib terminates radially outward from said locating pin axis in a first crush rib apex which is linear;

said second crush rib terminates radially outward from said locating pin axis in a second crush rib apex which is linear; and said first crush rib apex and said second crush rib apex lie in a common plane.

13. The internal combustion engine as in claim 12, wherein said locating pin axis is coincident with said common plane.

14. The internal combustion engine as in claim 12, wherein:

said first crush rib is arc-shaped when viewed in a third direction parallel to said locating pin axis; and said second crush rib is arc-shaped when viewed in said third direction parallel to said locating pin axis.

15. The internal combustion engine as in claim 12, wherein:

said first crush rib apex is inclined relative to said locating pin axis such that said first crush rib apex is closer to said locating pin axis at a first location proximal to said locating pin free end than at a second location proximal to said locating pin fixed end; and said second crush rib apex is inclined relative to said locating pin axis such that said second crush rib apex is closer to said locating pin axis at a third location proximal to said locating pin free end than at a fourth location proximal to said locating pin fixed end.

16. The internal combustion engine as in claim 12, wherein said first crush rib and said second crush rib bifurcate an outer periphery of said locating pin into a first locating pin surface and a second locating pin surface.

17. The internal combustion engine as in claim 16, wherein:

a first distance radially outward from a point on said locating pin axis to said first crush rib apex is no more than 25% greater than a second distance radially outward from said point on said locating pin axis to an intersection of said first locating pin surface and said first crush rib; and a third distance radially outward from said locating pin axis to said second crush rib apex is no more than 25% greater than a distance radially outward from said locating pin axis to an intersection of said second locating pin surface and said second crush rib.

18. The internal combustion engine as in claim 16, wherein:

a first crush rib inflection is formed on each side of said first crush rib which define an extent to which said first crush rib extends around a periphery of said locating pin; and a second crush rib inflection is formed on each side of said second crush rib which define an extent to which said second crush rib extends around said periphery of said locating pin.

19. The internal combustion engine as in claim 18, wherein:

said first crush rib extends no more than 45° about said locating pin axis; and said second crush rib extends no more than 45° about said locating pin axis.

20. A method of assembling a fuel injector to an internal combustion engine where the internal combustion engine includes a fuel injector receiving bore and a locating bore and where the fuel injector includes a nozzle body extending along a nozzle body axis; a valve housing held in fixed relationship to said nozzle body; and a locating pin extending from said valve housing along a locating pin axis from a locating pin fixed end which is fixed to said valve housing to a locating pin free end such wherein said locating pin axis is eccentric to said nozzle body axis; wherein said locating pin has 1) a width in a first direction radially relative to said nozzle body axis and through said locating pin axis and 2) a length in a second direction which is perpendicular to said width such that said width is less than said length; and said locating pin includes a first crush rib projecting outward therefrom and also includes a second crush rib projecting outward therefrom such that said first crush rib and said second crush rib are diametrically opposed at said length of said locating pin; said method comprising:

inserting said nozzle body into said fuel injector receiving bore;

inserting said locating pin into said locating bore; and plastically deforming said first crush rib and said second crush rib while said locating pin is being inserted into said locating bore such that said locating pin radially orients said nozzle body in said fuel injector receiving bore and thereby prevents rotational movement of said fuel injector about said nozzle body axis.

* * * * *